United States Patent [19]

Chesluk et al.

[11] 3,931,022

[45] Jan. 6, 1976

[54] TURBINE LUBRICANT AND METHOD

[75] Inventors: Ralph P. Chesluk; Norman R. Odell; Lawrence F. Kuntschik, all of Nederland; James A. White, Houston, all of Tex.

[73] Assignee: Texaco Inc., New York, N.Y.

[22] Filed: Sept. 16, 1974

[21] Appl. No.: 506,089

[52] U.S. Cl. ..... 252/47.5; 252/49.6; 252/49.9; 252/50; 252/51.5 R; 252/78

[51] Int. Cl.[2] ..... C10M 1/38; C10M 3/32; C10M 5/28; C10M 7/36

[58] Field of Search ..... 252/47.5, 49.6, 49.9, 50, 252/51.5 R, 78

[56] References Cited

UNITED STATES PATENTS

| | | | |
|---|---|---|---|
| 3,609,077 | 9/1971 | Breitigam | 252/49.9 |
| 3,707,500 | 12/1972 | Romano et al. | 252/49.9 |
| 3,778,376 | 12/1973 | Herber | 252/49.9 |
| 3,790,481 | 2/1974 | Byford et al. | 252/49.9 |

*Primary Examiner*—Delbert E. Gantz
*Assistant Examiner*—I. Vaughn
*Attorney, Agent, or Firm*—T. H. Whaley; C. G. Ries; Henry W. Archer

[57] ABSTRACT

Described herein is a lubricating composition exhibiting vapor space rust protection, improved oxidation stability and air release properties comprising a mineral lubricating oil containing from 0.02 to 3.0 weight percent vapor space rust inhibitor such as a $C_8$–$C_{10}$ aliphatic carboxylic acid; 0.001 to 0.3 wt % substituted heterocyclic antioxidant such as benzotriazole; 0.05 to 1.0 wt % of a rust inhibitor such as alkyl-succinic acid-/alkyl acid phosphate/phenol; 0.001 to 0.500 wt % polymeric antifoamant such as a polyacrylate; 0.01 to 5.0 wt % of an aryl phosphate such as tricresylphosphate; and 0.01 to 2.00 wt % of a hindered alkyl phenol antioxidant such as 4-methyl-2, 6-di-t-butylphenol.

13 Claims, No Drawings

TURBINE LUBRICANT AND METHOD

BACKGROUND OF THE INVENTION

1. Field of the Invention

This invention is concerned with a new lubricating composition and method for use in main turbines and gears, auxiliary turbine installations, certain hydraulic equipment and for general mechanical lubrication.

The lubrication of turbine engines, particularly those used in environments containing water requires lubricants which exhibit effective rust inhibition both during engine operation and while idle. In addition these lubricants must provide the desired oxidation stability, air release, and extreme pressure/antiwear properties.

The compositions of the invention exhibit excellent vapor space rust protection, improved oxidation stability, extreme pressure/antiwear, and air release properties.

2. State of the Art

The art to which this invention relates already is aware, inter alia, of U.S. Pat. No. 2,775,560. This patent discloses the use of carboxylic acids as vapor space rust inhibitors but indicates that such acids, to give vapor space rust protection, must be activated by oil soluble sulfur-containing compounds, phenolic compounds and/or by aliphatic polycarboxylic acids and their derivatives.

While the compositions claimed in U.S. Pat. No. 2,775,560 reportedly provide vapor phase rust protection, no mention is made that carboxylic acids VSI additives degrade the other critical properties of the lubricating oil. In fact, the other properties (oxidation stability and bearing compatibility) critical for these oils are ignored which implies that the claimed formulations may be deficient in these areas. The addition of only the VSI additive (even in the presence of phenolic and aliphatic polycarboxylic acid compounds as claimed in U.S. Pat. No. 2,775,560) degrades the oil performance in the critical areas. By contrast the present invention discloses a lubricating oil that not only provides vapor space rust protection, but exhibits outstanding liquid rust protection, oxidation stability, bearing compatibility, and air release properties.

SUMMARY OF THE INVENTION

Viewed in its composition aspect, the invention sought to be patented resides in a lubricating oil having an SUS viscosity at 100°F. between 70 and 5000 containing 0.001 to 3.0 weight percent of a vapor space rust inhibitor such as $C_8$–$C_{10}$ carboxylic acid; 0.001 to 0.3 weight percent of benzotriazole; 0.05 to 1 wt. % of antirust concentrate; 0.001 to 0.50 wt. % of polyacrylate antifoam agent; 0.01 to 5.0 wt. % of tricresyl phosphate and 0.01 to 2.0 wt. % of 4-methyl-2,6-di-t-butylphenol.

In its process aspect, the invention comprises employing the above described composition in a power system including metallic conduit and friction-creating sliding surfaces susceptible to rusting wherein the composition is at least intermittently in contact with some parts of the metallic surfaces.

The compositions of the invention meet the requirements of MIL-L-17731F Amendment 2 and MIL-L-24467 Specifications.

The $C_8$ – $C_{10}$ acids serve to provide vapor space rust inhibition and can be of nominal 90–100 percent purity. The $C_8$ – $C_{10}$ normal aliphatic monocarboxylic acids are preferred.

The above discussed acids tend to degrade the oxidation stability of the lubricating oil when used alone as shown in Table I. However, this effect is neutralized by using a secondary oxidation inhibitor such as benzotriazole. Other compounds which can be used are tolytriazole, dihydroxy benzotriazole, alkyl aminotriazoles such as dodecyl-2-amino-1,3,4-triazole and other substituted heterocyclic compounds such as those represented by the general structure and specific structures listed below:

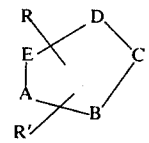

wherein R and $R_1$ can be alkyl or aryl, straight or branched chain, R and $R_1$ can be cyclic constituting a six membered ring e.g. benzene or a substituted benzene ring. R and $R_1$ can contain from one to 30 carbon atoms each but are preferably from 3 to 21 carbon atoms. Other vapor space inhibitors also can be used.

At least one member of the ring ABCDE should be carbon, preferably A and E. The other members can be N, O or S or any combination of the three atoms. It is preferably that at least one of the atoms is nitrogen.

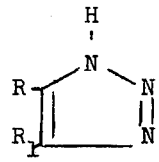

1,2,3-Triazole

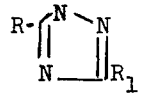

1,2,4-Triazole

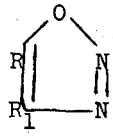

1,2,3-Oxadiazole

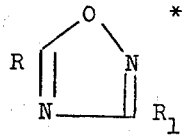

1,2,4-Oxadiazole (Azoxime)

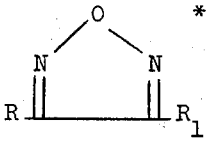

1,2,5-Oxadiazole (Furazan)

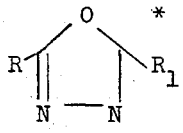

1,3,4-Oxadiazole

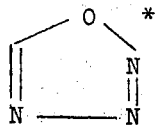

1,2,3,4-Oxatriazole

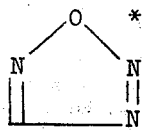

1,2,3,5-Oxatriazole

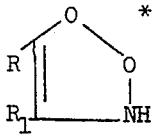

1,2,3-Dioxazole

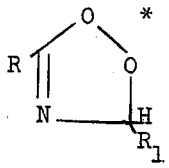

1,2,4-Dioxazole

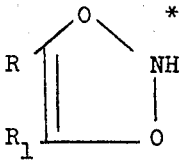

1,3,2-Dioxazole

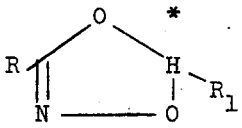

1,3,4-Dioxazole

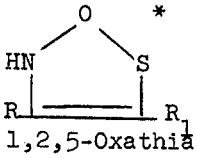

1,2,5-Oxathiazole

*Sulfur can be substituted for oxygen to form thia or thio products.

The antirust concentrate (ARC hereinafter) contains 1.5 weight percent of phenol and oil soluble polycarboxylic acids with alkyl groups of 6 to 30 carbon atoms and preferably 8 to 20 carbon atoms. Such acids include $C_8$ to $C_{20}$ alkyl or alkenyl malonic, succinic glutaric, adipic and pimelic acids with the $C_{10}$, $C_{12}$, $C_{14}$, $C_{16}$, $C_{18}$ and $C_{20}$ alkenyl succinic acids being preferred. In the compositions listed below the concentrate was a mixture of 90–91 wt. percent of a 50–50 weight mixture of C/2 alkylmaleic acid and 100E Pale Oil; 7.5 weight percent of alkyl acid orthophosphate and 1.51 weight percent phenol.

The polyacrylate antifoamant preferably is poly (2-ethylhexyl) acrylate in the form of a 40% kerosene solution. This additive provides air release properties. Other suitable antifoamant agents include the customary dimethyl silicone polymers.

Tricresyl phosphate serves to provide load carrying properties.

Other suitable load carrying additives include triethyl phosphate, tripropyl phosphate, tributyl phosphate, dicresylphenyl phosphate, cresyldiphenyl phosphate, diethylphenyl phosphate, ethyldiphenyl phosphate, dipropylphenyl phosphate, propyldiphenyl phosphate, dibutylphenyl phosphate, butyldiphenyl phosphate. Other types of load carrying additives which can be used include all combinations of dialkyl acid phosphates wherein the alkyl groups can be ethyl, propyl, butyl, or mixtures thereof alkyl aromatic amines such as dodecylaninline where the (alkyl group can be $C_4$ to $C_{20}$ straight or branched chain), sulfurized olefins where the olefin can be from $C_3$ to $C_{30}$ branched or straight chain either naturally derived mixtures or individual olefins prepared from suitable feedstocks. Sulfurization is carried out by the regular procedure familiar to those skilled in the art.

The preferred oxidation inhibitor is 4-methyl-2,6-di-t-butylphenol (MDBP). But other suitable antioxidants include 2,4,6-trimethyl phenol, 2,4-dimethyl-6-tertiarybutyl phenol, 2,6-ditertiarybutyl phenol, 2,6-ditertiarybutyl-4-butylphenol, and 2,2'methylene bis(4-methyl-6-tertiarybutyl phenol.

Preferred compositions of this invention are tabulated below. Test results demonstrating their effectiveness for the purposes stated are presented in Tables I and II.

| COMPOSITION A | | |
|---|---|---|
| ARC | Percent Wt. | 0.1 |
| 2,6-ditertiarybutyl-4-methyl phenol | do. | 0.3 |
| Tricresyl phosphate | do. | 2.0 |
| Caprylic acid | do. | 0.075 |
| Benzotriazole | do. | 0.02 |
| Polyacrylate antifoamant | ppm | 50 |
| Mineral Oil | | Balance |

| COMPOSITION B | | |
|---|---|---|
| ARC | Percent Wt. | 0.1 |
| 2,6-ditertiarybutyl-4-methyl phenol | do. | 0.3 |
| Tricresyl phosphate | do. | 2.0 |
| Pelargonic acid | do. | 0.075 |
| Benzotriazole | do. | 0.02 |
| Polyacrylate antifoamant | ppm | 50 |
| Mineral Oil | | Balance |

| COMPOSITION C | | |
|---|---|---|
| ARC | Percent Wt. | 0.10 |
| 2,6-ditertiarybutyl-4-methyl phenol | do. | 0.3 |
| Tricresyl phosphate | do. | 2.0 |
| Capric acid | do. | 0.075 |
| Benzotriazole | do. | 0.02 |
| Polyacrylate antifoamant | ppm | 50 |
| Mineral Oil | | Balance |

| COMPOSITION D | | |
|---|---|---|
| ARC | Percent Wt. | 0.05 |
| 2,6-ditertiarybutyl-4-methyl phenol | do. | 0.3 |
| Tricresyl phosphate | do. | 2.0 |
| Caprylic acid | do. | 0.075 |
| Benzotriazole | do. | 0.02 |
| Polyacrylate antifoamant | ppm | 50 |
| Mineral Oil | | Balance |

| COMPOSITION E | | |
|---|---|---|
| ARC | Percent Wt. | 0.05 |
| 2,6-ditertiarybutyl-4-methyl phenol | do. | 0.3 |
| Tricresyl phosphate | do. | 2.0 |
| Caprylic acid | do. | 0.1 |

-continued

| COMPOSITION E | | |
|---|---|---|
| Benzotriazole | do. | 0.02 |
| Polyacrylate antifoamant | ppm | 50 |
| Mineral Oil | | Balance |

| COMPOSITION F | | |
|---|---|---|
| ARC | Percent Wt. | 0.05 |
| 2,6-ditertiarybutyl phenol | do. | 0.3 |
| Tricresyl phosphate | do. | 2.0 |
| Caprylic acid | do. | 0.10 |
| Benzotriazole | do. | 0.02 |
| Dimethylsilicone polymer | ppm | 50 |
| Mineral Oil | | Balance |

| COMPOSITION G | | |
|---|---|---|
| ARC | Percent Wt. | 0.05 |
| 2,6-ditertiarybutyl phenol | do. | 0.3 |
| Tricresyl phosphate | do. | 2.0 |
| Caprylic acid | do. | 0.1 |
| Dimethyl silicone polymer | ppm | 50 |
| Mineral Oil | | Balance |

| COMPOSITION H | | |
|---|---|---|
| ARC | Percent Wt. | 0.05 |
| 2,6-ditertiarybutyl-4-methyl phenol | do. | 0.3 |
| Tricresyl phosphate | do. | 2.0 |
| Dimethylsilicone polymer | ppm | 50 |
| Mineral Oil | | Balance |

| COMPOSITION I | | |
|---|---|---|
| ARC | Percent Wt. | 0.05 |
| 2,6-ditertiarybutyl-4-methyl phenol | do. | 0.3 |
| Tricresyl phosphate | do. | 2.0 |
| Benzotriazole | do. | 0.02 |
| Dimethyl silicone polymer | ppm | 50 |
| Mineral Oil | | Balance |

| COMPOSITION J | | |
|---|---|---|
| ARC | Percent Wt. | 0.05 |
| 2,6-ditertiarybutyl-4-methyl phenol | do. | 0.3 |
| Tricresyl phosphate | do. | 2.0 |
| Caprylic acid | do. | 0.10 |
| Tolutriazole | do. | 0.02 |
| Dimethyl silicone polymer | ppm | 50 |
| Mineral Oil | | Balance |

-continued

| COMPOSITION J | | |
|---|---|---|
| COMPOSITION K | | |
| ARC | Percent Wt. | 0.05 |
| 2,6-ditertiarybutyl-4-methyl phenol | do. | 0.3 |
| Tricresyl phosphate | do. | 2.0 |
| Caprylic acid | do. | 0.10 |
| Dihydroxybenzotriazole | do. | 0.02 |
| Dimethyl silicone polymer | ppm | 50 |
| Mineral Oil | | Balance |

| COMPOSITION L | | |
|---|---|---|
| ARC | Percent Wt. | 0.05 |
| 2,6-ditertiarybutyl phenol | do. | 0.3 |
| Tricresyl phosphate | do. | 2.0 |
| Caprylic acid | do. | 0.075 |
| Benzotriazole | do. | 0.02 |
| Polyacrylate antifoamant | ppm | 50 |
| Mineral Oil | | Balance |

It can be seen from Table I that Composition A through G satisfactorily pass the Vapor Space Corrosion Test while Compositions H and I which do not contain a $C_8$ to $C_{10}$ normal carboxylic acid fail the test. Although Compositions H and I are deficient in vapor space rust protection, both compositions have satisfactory oxidation stability and liquid phase rust protection. Compositions A and F which contain a substituted triazole (benzotriazole) have good RBOT values and pass the ASTM D-943 Oxidation Test while Composition G which does not contain a substituted triazole has a low RBOT and fails the ASTM D-943 Oxidation Test.

The data presented in Table II indicate that only compositions containing all of the above named ingredients (for example composition A) will provide the necessary air release, Navy Work Factor, and Ryder Gear Test levels required by MIL-L-24467.

Composition G fails the Navy Work Factor Test and Composition H has an extremely long air release time

TABLE I

| COMPOSITION | VAPOR SPACE CORROSION TEST[1] | MILITARY RUST[2] | RBOT Minutes[3] | ASTM D-943 Oxidation |
|---|---|---|---|---|
| A | Pass | Pass | 352 | Pass |
| B | Pass | Pass | — | — |
| C | Pass | Pass | — | — |
| D | Pass | Pass | — | — |
| E | Pass | Pass | — | — |
| F | Pass | Pass | 322,252 | Pass |
| G | Pass | Pass | 112,162 | Fail |
| H | Fail | Pass | 183 | Pass |
| I | Fail | Pass | 393,250 | — |
| J | Pass | Pass | — | Pass |
| K | Pass | Pass | — | Pass |
| L | Pass | Pass | — | Pass |

[1]Test is run according to MIL-L-24467 Appendix B with an 180°F oil bath substituted for 230–240°F hot plate surface temperature.
[2]Oil is washed with water and then run in ASTM D-665 Procedure B.
[3]ASTM D-2272.
[4]A 1000 hour minimum oxidation life with a 100 milligrams maximum sludge and less than a 100 milligrams total of copper and iron is required by both MIL-L-17331 and MIL-L-24467.

TABLE II

| Composition | LA Air Release, min. | Navy Work Factor Test[1] Visual | Numerical | Ryder Gear Test[2] |
|---|---|---|---|---|
| A | 8,12,26 | Pass | Pass | Pass |
| G | — | Fail | Fail | — |
| H | 140 | Pass | Pass | Pass |
| I | — | Pass | Pass | Pass |
| J | 140 | Pass | Pass | Pass |
| K | 140 | Pass | Pass | Pass |
| L | 10,15 | Pass | Pass | Pass |

[1]Passing results in both the visual and numerical portions is required by MIL-L-17331 and MIL-L-24467.
[2]A 2200 ppi minimum level is required by MIL-L-17331 and MIL-L-24467.

typical of lubricatns containing polymeric silicone antifoamants.

Thus, it can be seen from data presented in Tables I and II that addition of only a vapor space rust inhibitor to a regular turbine oil degrades the oxidation stability and Work Factor Test results (Compare G a regular turbine oil plus vapor space corrosion inhibitor with H a regular turbine oil). Similarly, the addition of only a substituted triazole such as benzotriazole to a regular turbine oil will not provide satisfactory protection against vapor space rusting (see I in Table I). Likewise, the polyacrylate antifoamant is required to provide adequate air release for critical applications; for non-critical applications a polymeric silicone antifoamant is acceptable.

It is well known in the art that a rust inhibitor and an antioxidant are required to provide the necessary protection against rusting in the liquid phase (contact rust inhibitor) and oxidation stability. Therefore, it can be seen that all of the ingredients claimed are required to provide the level of performance necessary to meet MIL-L-24467.

It will be appreciated that other known lubricating oil additives also can be incorporated in the formulations of the invention to impart thereto additional properties.

Thus it will now be obvious to those skilled in the art many modifications and variations of the compositions set forth above. These modifications and variations will not depart from the scope of the invention, however, if defined by the following claims.

What is claimed is:

1. A vapor phase rust inhibiting, oxidation stable, lubricating composition having improved air release properties and comprising in combination, a major amount of a mineral lubricating oil having an SUS viscosity at 100°F. between 70 and 5000; a minor effective oxidation stabilizing amount of a heterocyclic antioxidant compound of the formula:

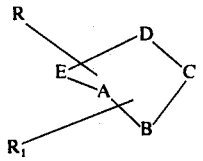

wherein R and $R_1$ are alkyl or aryl, straight or branched chain, or form a six membered ring and have one to 30 carbon atoms each; or can be absent and at least one member of the group ABCDE is carbon and at least three other members are selected from the group of nitrogen, oxygen and sulfur, a minor effective antifoaming amount of an antifoaming agent, a minor effective vapor phase rust inhibiting amount of a $C_8$ to $C_{10}$ aliphatic monocarboxylic acid, a minor work load improving amount of tricresylphosphate and a minor effective antioxidant amount of an alkylphenol antioxidant.

2. A composition in accordance with claim 1 wherein the monocarboxylic acid is caprylic acid.

3. A composition in accordance with claim 1 wherein the monocarboxylic acid is pelargonic acid.

4. A composition in accordance with claim 1 wherein the monocarboxylic acid is capric acid.

5. A composition in accordance with claim 1 wherein the antifoamant is a dimethyl silicone polymer.

6. A composition in accordance with claim 1 wherein said heterocyclic antioxidant is tolutriazole.

7. A composition in accordance with claim 1 wherein said heterocyclic antioxidant is dihydrobenzotriazole.

8. A composition according to claim 1 containing:

| | | |
|---|---|---|
| (Anti-rust concentrate) | % wt. | 0.1 |
| 2,6-ditertiarybutyl-4-methyl phenol | " | 0.3 |
| Tricresyl phosphate | " | 2.0 |
| Caprylic acid | " | 0.075 |
| Benzotriazole | " | 0.02 |
| Polyacrylate antifoamant | 50 | 50 |
| Mineral Oil | | Balance. |

9. A composition according to claim 1 containing:

| | | |
|---|---|---|
| (Anti-rust concentrate) | % Wt. | 0.1 |
| 2,6-ditertiarybutyl-4-methyl phenol | " | 0.3 |
| Tricresyl phosphate | " | 2.0 |
| Pelargonic acid | " | 0.075 |
| Benzotriazole | " | 0.02 |
| Polyacrylate antifoamant | ppm | 50 |
| Mineral Oil | | Balance. |

10. A composition according to claim 1 containing:

| | | |
|---|---|---|
| (Anti-rust concentrate) | % wt. | 0.10 |
| 2,6-ditertiarybutyl-4-methyl phenol | " | 0.3 |
| Tricresyl phosphate | " | 2.0 |
| Capric acid | " | 0.075 |
| Benzotriazole | " | 0.02 |
| Polyacrylate antifoamant | ppm | 50 |
| Mineral Oil | | Balance. |

11. A composition according to claim 1 containing:

| | | |
|---|---|---|
| (Anti-rust concentrate) | % wt. | 0.05 |
| 2,6-ditertiarybutyl-4-methyl phenol | " | 0.3 |
| Tricresyl phosphate | " | 2.0 |
| Caprylic acid | " | 0.075 |
| Benzotriazole | " | 0.02 |
| Polyacrylate antifoamant | ppm | 50 |
| Mineral Oil | | Balance. |

12. A composition according to claim 1 containing:

| | | |
|---|---|---|
| (Anti-rust concentrate) | % wt. | 0.05 |
| 2,6-ditertiarybutyl-4-methyl phenol | " | 0.3 |
| Tricresyl phosphate | " | 2.0 |
| Caprylic acid | " | 0.1 |
| Benzotriazole | " | 0.02 |
| Polyacrylate antifoamant | ppm | 50 |
| Mineral Oil | | Balance. |

13. A composition according to claim 1 containing:

| | | |
|---|---|---|
| (Anti-rust concentrate) | % wt. | 0.05 |
| 2,6-ditertiarybutyl phenol | " | 0.3 |
| Tricresyl phosphate | " | 2.0 |
| Caprylic acid | " | 0.10 |
| Benzotriazole | " | 0.02 |
| Dimethylsilicone polymer | ppm | 50 |
| Mineral Oil | | Balance. |

* * * * *